US005294020A

United States Patent [19]

Kunz

[11] Patent Number: 5,294,020

[45] Date of Patent: Mar. 15, 1994

[54] DISPENSING MECHANISM FOR CYLINDRICAL PRODUCTS

[75] Inventor: Steven A. Kunz, Pfafftown, N.C.

[73] Assignee: Decision Point Marketing, Inc., Winston Salem, N.C.

[21] Appl. No.: 878,390

[22] Filed: May 4, 1992

[51] Int. Cl.[5] ..... B65G 59/00

[52] U.S. Cl. ..... 221/131; 221/281; 221/311; 221/312 R; 221/1; 312/45

[58] Field of Search ..... 221/1, 131, 132, 194, 221/281, 303, 311, 312 R, 312 B, 312 C; 312/72, 73, 45, 49, 60

[56] References Cited

U.S. PATENT DOCUMENTS

| | | | |
|---|---|---|---|
| 1,477,501 | 12/1923 | Keenan | 221/312 R |
| 1,782,597 | 11/1930 | Blackman | 221/311 |
| 2,119,700 | 6/1938 | Burgess | 312/45 |
| 2,360,573 | 10/1944 | Mena | 221/311 |
| 3,221,930 | 12/1965 | Nasgowitz | 221/311 |
| 3,298,763 | 1/1967 | Domenico | 312/45 |

FOREIGN PATENT DOCUMENTS

| | | | |
|---|---|---|---|
| 1386781 | 12/1964 | France | 221/311 |

*Primary Examiner*—H. Grant Skaggs

*Attorney, Agent, or Firm*—Rhodes, Coats & Bennett

[57] ABSTRACT

An apparatus for displaying and dispensing cylindrical objects having a diameter and a length along an axis includes a base supporting a reservoir configured and arranged to hold a plurality of cylindrical objects to be dispensed. The reservoir communicates with a downwardly and forwardly extending chute terminating in a forward display position on the base. The cylindrical object displayed in the display position is axially distended from the plurality of cylindrical objects held in the reservoir. Thus, upon loading a plurality of cylindrical objects into the reservoir, the chute and display position are filled with cylindrical objects and upon removal of a cylindrical object from the display position, cylindrical objects descend under the influence of gravity from the reservoir to the chute and from the chute to the display position.

30 Claims, 4 Drawing Sheets

DISPENSING MECHANISM FOR CYLINDRICAL PRODUCTS

The present invention relates to improvements in devices for dispensing cylindrical products, such as lipsticks, rolls of candies or breath mints or the like.

Displays for merchandising products have been known to take many different forms, relating to a certain extent to the configuration of the package being merchandised. Often, cylindrical products when sold one at a time are merchandised in open-topped boxes from which a customer may take an individual product for purchase.

Also known are dispensers in which a supply of cylindrical packages are provided with a gravity feed out of a reservoir into a display position, with the packages moving into the display position along a line perpendicular to their axes so that all of the packages have their ends in generally the same plane.

However, it is not known to be feed cylindrical packages from a reservoir, axially, so that the individual packages feed out to a display position to appear as individual packages. Providing them in such individual poses in a display position may well enhance the attractiveness of the product to a customer, thus increasing sales or, at any rate, presenting a distinctive product presentation.

SUMMARY OF THE INVENTION

The present invention fulfills this shortcoming of the art by providing an apparatus for displaying and dispensing cylindrical objects having a diameter and a length along an axis. A base supports a reservoir configured and arranged to hold a plurality of cylindrical objects to be dispensed, the reservoir communicating with a downwardly and forwardly extending chute terminating in a forward display position on the base. A cylindrical object displayed in the display position is axially distended from the plurality of cylindrical objects held in the reservoir. Thus, upon loading a plurality of cylindrical objects into the reservoir, the chute and display position are filled with cylindrical objects and upon removal of a cylindrical object from the display position, cylindrical objects descend under the influence of gravity from the reservoir to the chute and from the chute to the display position.

Preferably, the chute includes a portion to hold a cylindrical object next in line to descend to the display position which is forward of the reservoir and rearward of the display position. Typically, the cylindrical objects move a vertical distance approximating the diameter of the cylindrical objects and a forward distance at least one half the length of the cylindrical objects when descending to the display position.

In a preferred embodiment the chute is defined by sidewalls, a front wall and a back wall and the front wall includes rearwardly projecting ribs having beveled edges to guide the forward portion of a descending cylindrical object toward the center of the display position with low friction. Desirably, the ribs are recessed to a plane forward of the reservoir to permit forward movement of a cylindrical object in moving to the ribs, and the ribs are slanted forwardly to permit forward movement of a cylindrical object in moving from the ribs.

Also preferred is for the back wall to include a forwardly extending curved ramp having ripples in it. The ripples are positioned to include a steeper ramp portion below a rear end of a cylindrical article at rest next above the cylindrical article in the display position. The ripples also include a steeper ramp portion upstream of a rear end of a cylindrical article in the display position and downstream of a rear end of a cylindrical article at rest next above the cylindrical article in the display position. Preferably, the back wall is configured as a ramp formed of lateral shoulders with a central recess.

Preferably, the reservoir has baffles to prevent continuous movement of a cylindrical article falling therethrough under the influence of gravity. In a preferred embodiment the reservoir is configured to store a plurality of cylindrical objects in a curved queue. Also preferably, the apparatus includes a multiplicity of reservoirs and associated chutes and display positions mounted on a common base. Particularly preferred is for the apparatus to have four reservoirs and associated chutes and display positions mounted on a common base, with two central display positions at a higher level on the base than two outer display positions.

Desirably, the reservoir includes a back wall having apertures therein to permit visual inspection of an inventory held in the reservoir and to permit the insertion of a tool to dislodge jammed ones of the cylindrical articles. In a particularly preferred embodiment the reservoir, chute and display position are sized to hold at least 20 cylindrical packages.

The apparatus may be made of injection molded plastic components solvent welded together. In a preferred embodiment the plastic is a copolyester resistant to degradation by mint oil.

The invention also provides a method of displaying and dispensing cylindrical objects having a diameter and a length along an axis. The method includes the steps of providing a reservoir communicating with a downwardly and forwardly extending chute terminating in a forward display position axially distended from the reservoir, and loading a plurality of cylindrical objects into the reservoir, and thereby filling the chute and display position with cylindrical objects, holding the plurality of cylindrical objects in the reservoir with a cylindrical object in the display position available for removal by hand. Upon removing a cylindrical object from the display position, cylindrical objects are induced to descend under the influence of gravity from the reservoir forwardly to the chute and from the chute forwardly to the display position.

Preferably, the holding step includes holding a cylindrical object next in line to descend to the display position forward of the reservoir and rearward of the display position.

Desirably, in the move induced by the removing step the cylindrical objects move a vertical distance approximating the diameter of the cylindrical objects and a forward distance at least one half the length of the cylindrical objects and toward the center of the display position with low friction. Preferably, in the move induced by the removing step a cylindrical object moves from the reservoir to the ribs and a cylindrical object moves from the ribs to the display position.

Desirably, the loading step includes causing cylindrical articles being loaded to collide with baffles in the reservoir to prevent continuous movement of cylindrical articles and storing a plurality of cylindrical objects in a curved queue.

Preferably, the loading step includes loading a multiplicity of reservoirs and associated chutes and display positions on a common base.

For a reservoir including a back wall having aperatures therein the method may further include visually inspecting cylindrical articles in the reservoir through an aperture or inserting a tool through an aperture to dislodge jammed ones of the cylindrical articles.

BRIEF DESCRIPTION OF THE DRAWINGS

The invention will be better understood from a reading of the detailed description of the preferred embodiment along with a review of the drawings in which.

DETAILED DESCRIPTION OF THE PREFERRED EMBODIMENT

Figure 1:
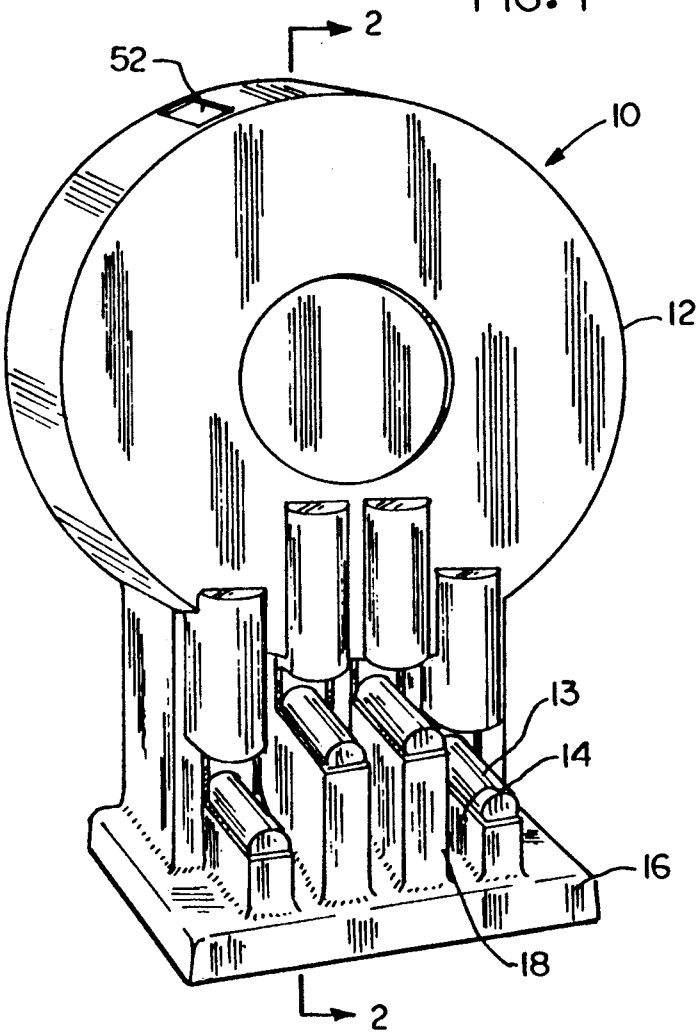
FIG. 1 is a perspective view of a preferred embodiment of the invention.

As can be seen in FIG. 1, a dispenser 10 according to a preferred embodiment is provided with a reservoir housing 12 supported by a base 16. Also supported on the base 16 are a plurality of display positions 14, 18 for articles to be dispensed. The embodiment shown in the figures four reservoirs and associated display positions for four cylindrical articles, permitting multiple products to be dispensed or a larger quantity of a given product to be dispensed through the dispenser 10. Locating display position 18 at a higher level than the display position 14 gives a distinctive appearance as well as facilitating a customer's removing a product for purchase. Additional upper and lower display positions are also shown in FIG. 1. In the invention, articles in the display position are axially distended from the articles still held above it in the reservoir. Preferably, the distention is of at least ½ the length of the article and more preferably, it is greater than ¾.

Figure 2:
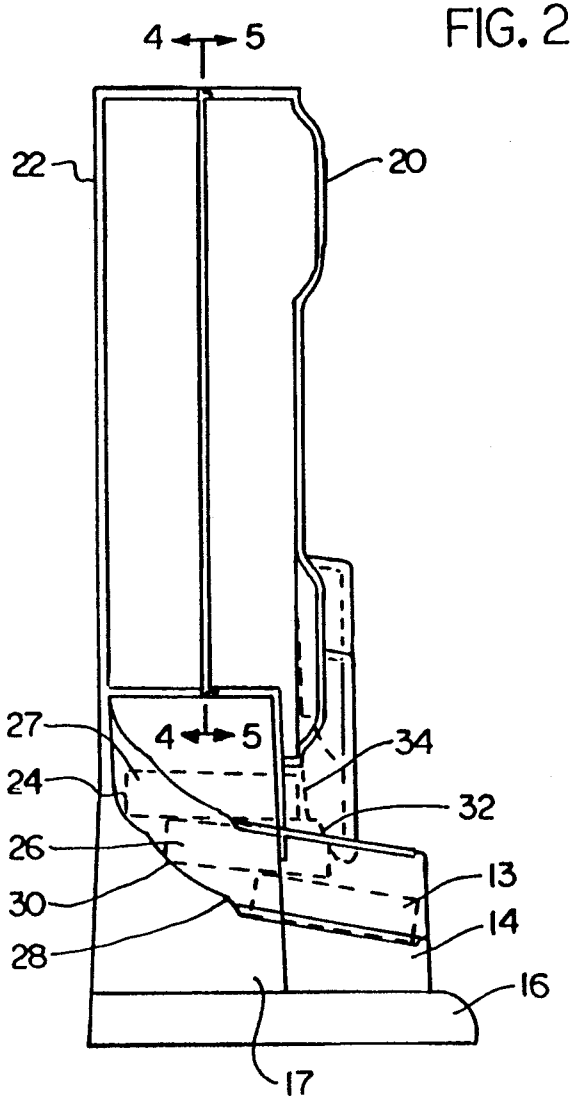
FIG. 2 is a sectional view of the embodiment of FIG. 1 taken along lines 2—2 and looking in the direction of the arrows.

As can be seen in FIG. 2, the dispenser 10 is made up of three major components, all preferably made of injection molded plastic and solvent welded together. The three major components are a front reservoir half 20, a rear reservoir half 22, and a base unit 17. Other construction schemes may be used. While various plastics can be used in the injection molding construction, in a preferred embodiment, the dispenser is used for dispensing rolls of mints, requiring a special material. The oil of mint can distort or attack some plastics, but not PETG or PCTG copolyester plastics available from Ektar, Division of the Kodak Company, so those are preferred.

Figure 4:
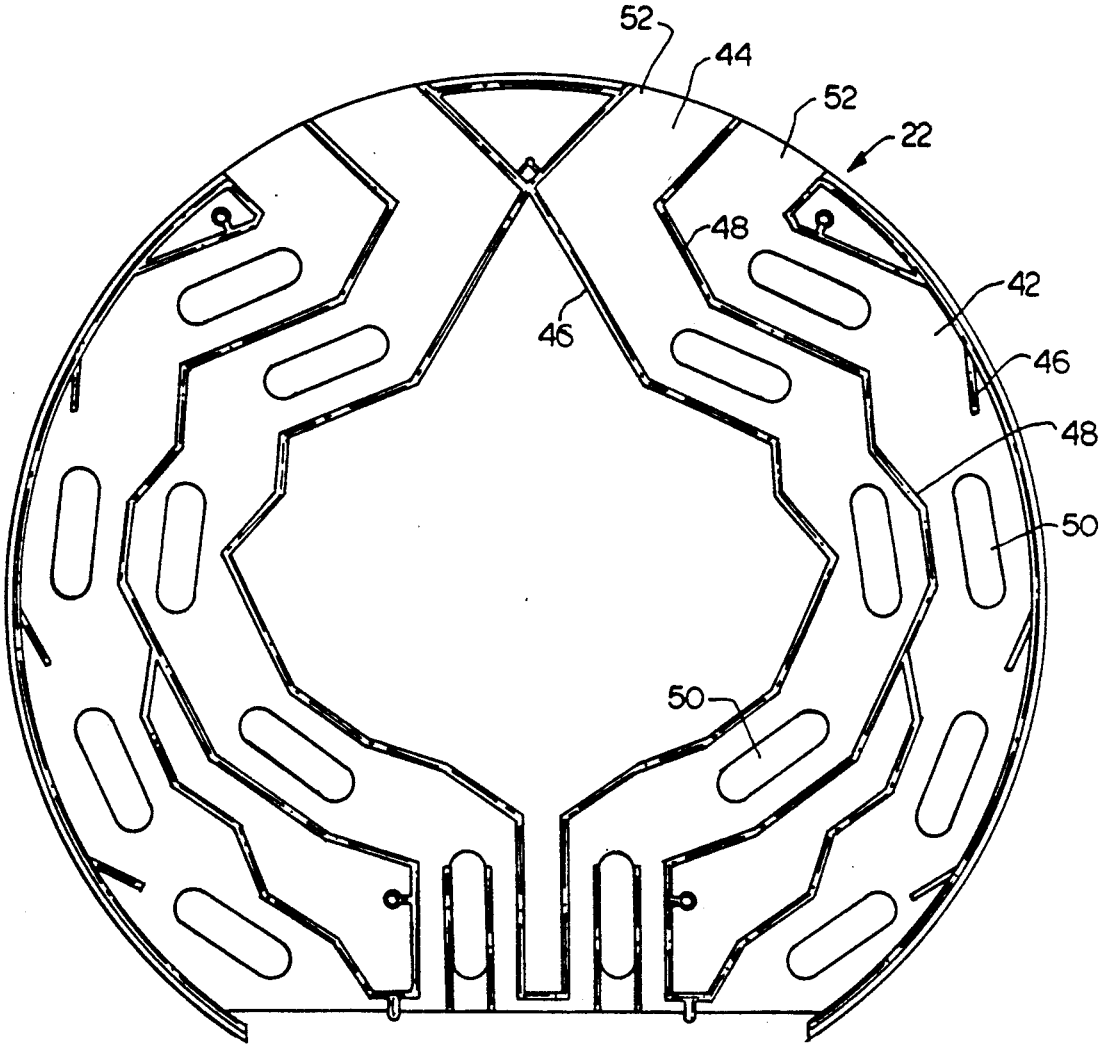
FIG. 4 is a rear elevational view of one-half of the reservoir of the embodiment, taken along lines 4—4 in FIG. 4 and looking in the direction of the arrows.
Figure 5:
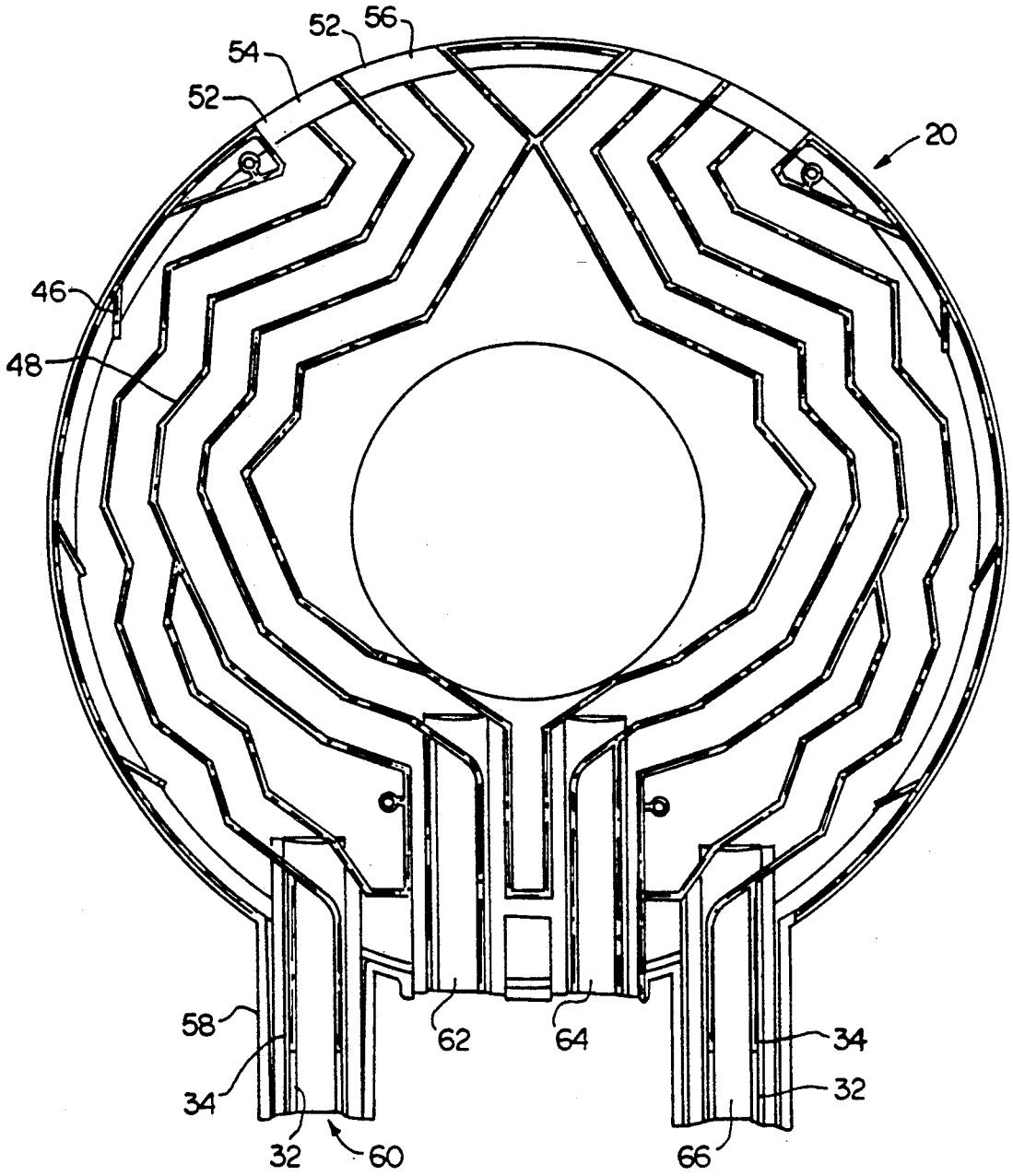
FIG. 5 is an elevational view of the front half of the reservoir of the embodiment, taken along lines 5—5 in FIG. 2 and looking in the direction of the arrows.

As seen in FIG. 2, the front and rear halves 20,22 have multiple details omitted for the sake of clarity, but these are shown in FIGS. 4 and 5. Below the reservoir section is a chute section 24 terminating in a display position 14. As seen in FIG. 2, multiple ones of cylindrical articles are shown labeled with reference numerals 13,26,27.

The chute includes a curved ramp having ripples in it. The surface includes a steeper portion 28 and further steeper portion 30 which help to guide and forwardly urge the cylindrical articles as they descend from the reservoir to the display position 14. As can be seen, steeper portion 28 is positioned between the cylindrical article 13 in the display position and the cylindrical article 26 just above it. Similarly, the steeper portion 30 is positioned between the rear end of the article 26 and the article 13.

Figure 6:
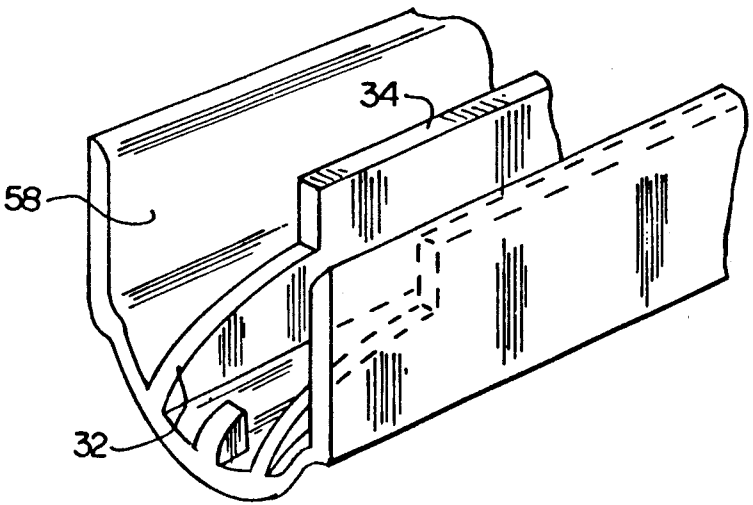
FIG. 6 is a perspective view of a lower end of a chute of the embodiment of FIG. 5.

Acting with these stepper portions of the chute are the front, rear-facing portions of the chute, made up primarily of ribs having lower portions 32 and upper portions 34. The upper portion 34 acts as a stop for the forward end of the third cylindrical article 27, and the lower portion 32 acts as a similar stop for the lower cylindrical article 26. However, as can be seen in FIG. 2, the lower portion 32 is cut away and recessed from the column of cylindrical articles extending up into the reservoir, acting to guide the cylindrical article 26 toward the display position 14. The ribs can be better seen in FIGS. 5 and 6 and include two spaced apart ribs for each chute. The inner edges of the ribs 32 are beveled inwardly to help guide the cylindrical articles toward the center of the chute, thus helping to guide them to the display position 14.

Figure 3:
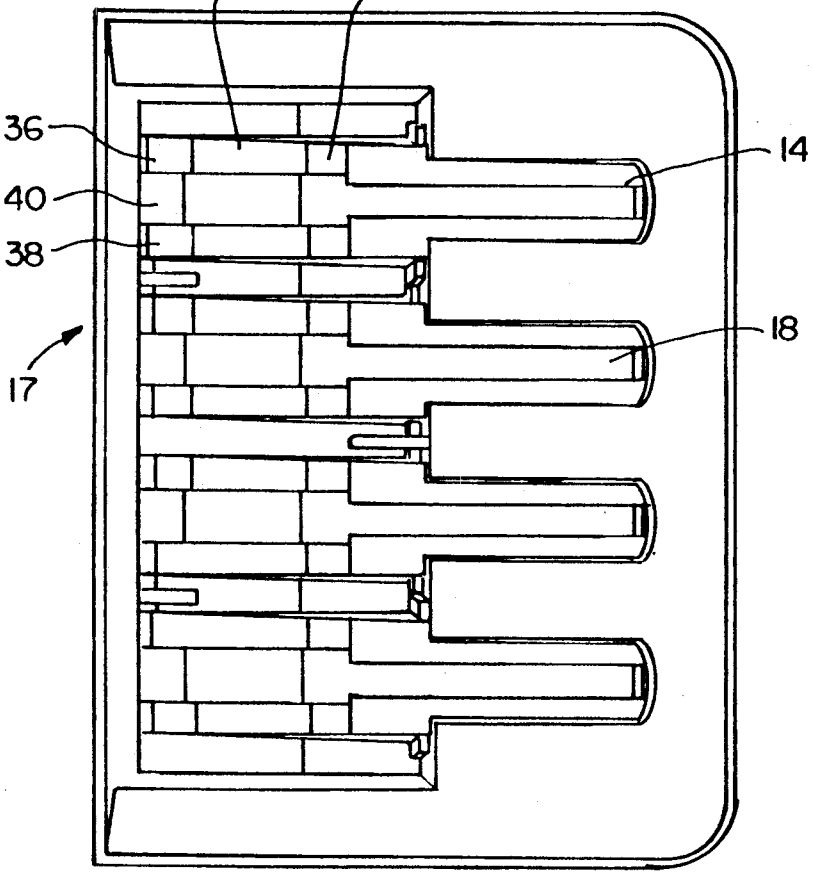
FIG. 3 is a top view of a base unit of the embodiment of FIG. 1.

Referring now to FIG. 3, the rear faces of the chute portions can be seen in better detail. Each rear face includes a pair of opposed shoulders 36 with an intermediate recess 40, providing two rail-like edges which coact with the rounded cylindrical surface of the article being dispensed to help to center the article and reduce friction to assure that the articles move freely to the display position. The shoulder and recess configurations continues through the chute portion and into the display position 14, as seen in FIG. 3.

As seen in FIG. 4, the rear half of the housing includes four reservoir halves, two of which are indicated with reference numerals 42,44. Each reservoir half takes a generally curved shape and is of a width slightly wider than the diameter of the cylindrical articles to be dispensed, resulting in the articles being stored in the reservoir in a generally curved queue. The reservoir is configured, however, not with continuous curved lines, but rather with a plurality of flat surfaces 48 to act as baffles. And, additional baffles 46 are added, resulting in a plurality of short straight segments in the path of the queue followed by each cylindrical article. The baffles 46,48 cause the straightening of a moving cylindrical article to help in preventing jamming of the articles in the reservoir.

Apertures 50 are provided in the rear wall of the rear housing. These apertures 50 serve dual purposes, to permit inspection of the inventory held in the reservoir to see if replenishment is needed, and also to permit elongate tools to be inserted to realign cylindrical articles in the event they do become jammed.

Referring now to FIG. 5, the front half of the housing may be seen. Particularly enumerated on the drawing are reservoirs halves 54,56, corresponding with and mating with rear reservoir halves 42,44, respectively. Each reservoir is loaded from the top through an opening 52 so that the cylindrical articles may be fed under the influence of gravity downwardly to fill the reservoir and its associated chute and display position.

As can be seen in FIG. 5, the front part of the chute 58 extends continuously downwardly from the associated reservoir. Each of the four reservoirs is provided with a respective chute 60,62,64,66 as seen in FIG. 5.

Use of the apparatus is straightforward. first, a plurality of cylindrical articles are loaded through the upper opening 52 so that they fall under the influence of gravity downwardly through the associated reservoir. The first article passes through the chute and lands at the display position 14. The second article follows until it reaches the position of cylindrical article 26 of FIG. 2, supported by the rear wall of the chute, the cylindrical article 13 and the lower portion 32 of the ribs. The third falls until it is supported by the rear wall of the chute, the article 26 and the upper portion 34 of the ribs. Further cylindrical articles pile up on top of the previously loaded cylindrical articles into the reservoir. In the embodiment shown, twenty articles may be loaded into the reservoir, chute and display position when filled.

Then, when a customer removes the cylindrical article 13 from the position 14, article 26 is no longer supported, so that it falls under the influence of gravity, exerted on the article and the column of articles above it. The rear wall of the chute forces the article forwardly and the tapered and beveled ribs 32 assist in guiding the front end downwardly, centered toward the display position 14, so that the article moves to the display position, where it stops. There located, the article is axially distended from the articles held in the reservoir above it, by at least ½ of its length. The article which had previously been above it then moves down to the position below it, again under the influence of gravity with the weight of articles above it, with the rear wall forcing it forward and the ribs 32, 34 accommodating its movement from the position of article 27 to the position of article 26 of FIG. 2. In this manner, articles are continually fed to the display position as they are removed therefrom, and yet feed readily from the reservoir to the display position, without jamming.

The invention has been particularly described with respect to the dispensing of rolls of mints, although the principles of the invention are widely adaptable to dispensing of other cylindrical articles or cylindrically packaged articles, such as lipstick tubes, lip balm tubes, or other similarly shaped articles. Of course, the dimensions of the article to be dispensed will determine the sizes, proportions and placement of various elements of the reservoir, chute and display position.

Those of ordinary skill in the art will appreciate that the present invention may take many different forms, all of which are deemed to be within the scope of this invention.

What is claimed is:

1. An apparatus for displaying and dispensing cylindrical objects having a diameter and a length along an axis comprising a base supporting a reservoir configured and arranged to hold a plurality of cylindrical objects to be dispensed, said reservoir communicating with a downwardly and forwardly extending chute for carrying the cylindrical objects forward of said reservoir and terminating in a forward display position on said base for a cylindrical object displayed such that cylindrical object in said display position is axially distended from the plurality of cylindrical objects held in said reservoir, said chute including a ramp having ripples contacted by a rear end of a cylindrical object as it moves forwardly from said reservoir to said display position, whereby upon loading a plurality of cylindrical objects into said reservoir, said chute and display position are filled with cylindrical objects and upon removal of a cylindrical object from said display position, cylindrical objects descend under the influence of gravity from said reservoir to said chute and from said chute to said display position.

2. An apparatus as claimed in claim 1 wherein said chute includes a portion to hold a cylindrical object next in line to descend to said display position which is forward of said reservoir and rearward of said display position.

3. An apparatus as claimed in claim 1 wherein the cylindrical objects move a vertical distance approximating the diameter of the cylindrical objects and a forward distance at least one half the length of the cylindrical objects when descending to said display position.

4. An apparatus as claimed in claim 1 wherein said ripples are positioned to include a steeper ramp portion below a rear end of a cylindrical article at rest next above the cylindrical article in said display position.

5. An apparatus as claimed in claim 4 wherein said ripples include a steeper ramp portion upstream of a rear end of a cylindrical article in said display position and downstream of a rear end of a cylindrical article at rest next above the cylindrical article in said display position.

6. An apparatus as claimed in claim 1 wherein said chute is defined by sidewalls, a front wall and a back wall and said back wall is configured as a ramp formed of lateral shoulders with a central recess.

7. An apparatus as claimed in claim 1 wherein said reservoir has baffles to prevent continuous movement of a cylindrical article falling therethrough under the influence of gravity.

8. An apparatus as claimed in claim 1 wherein said reservoir is configured to store a plurality of cylindrical objects in a curved queue.

9. An apparatus as claimed in claim 1 comprising a multiplicity of reservoirs and associated chutes and display positions mounted on a common base.

10. An apparatus as claimed in 1 comprising four reservoirs and associated chutes and display positions mounted on a common base, with two central display portions at a higher level on said base than two outer display positions.

11. An apparatus as claimed in claim 1 wherein said reservoir includes a back wall having apertures therein to permit visual inspection of an inventory held in said reservoir and to permit the insertion of a tool to dislodge jammed ones of the cylindrical articles.

12. An apparatus as claimed in claim 1 made of injection molded plastic components solvent welded together.

13. An apparatus as claimed in claim 12 wherein the plastic is a copolyester resistant to degradation by mint oil.

14. An apparatus as claimed in claim 1 wherein the reservoir, chute and display position are sized to hold at least 20 cylindrical packages.

15. An apparatus for displaying and dispensing cylindrical objects having a diameter and a length along an axis comprising a base supporting a reservoir configured and arranged to hold a plurality of cylindrical objects to be dispensed, said reservoir communicating with a downwardly and forwardly extending chute terminating in a forward display position on said base for a cylindrical object such that the cylindrical object displayed in said display position is axially distended from the plurality of cylindrical objects held in said reservoir, wherein said chute is defined by sidewalls, a front wall and a back wall and said front wall includes rearwardly projecting ribs having beveled edges to guide the forward portion of a descending cylindrical object toward the center of said display position with low friction whereby upon loading a plurality of cylindrical objects into said reservoir, said chute and display position are filled with cylindrical objects and upon removal of a cylindrical object from said display position, cylindrical objects descend under the influence of gravity from said reservoir to said chute and from said chute to said display position.

16. An apparatus as claimed in claim 15 wherein said ribs are recessed to a plane forward of said reservoir to permit forward movement of a cylindrical object in moving to said ribs.

17. An apparatus as claimed in claim 16 wherein said ribs are slanted forwardly to permit forward movement of a cylindrical object in moving from said ribs.

18. An apparatus as claimed in claim 15 wherein said back wall includes a forwardly-extending, curved ramp having ripples in it.

19. An apparatus for dispensing cylindrical objects having a diameter and a length along an axis and for displaying the objects at a display position comprising a base supporting a reservoir configured and arranged to hold a plurality of cylindrical objects to be dispensed in a curved queue and having baffles to prevent continuous movement of a cylindrical article falling therethrough under the influence of gravity and having a back wall having apertures therein to permit visual inspection of an inventory held in said reservoir and to permit the insertion of a tool to dislodge jammed ones of the cylindrical articles, said reservoir communicating with a downwardly and forwardly extending chute which has a portion to hold a cylindrical object next in line to descend to said display position and terminates at said display position forward on said base such that the cylindrical object displayed in the display position is axially distended from the plurality of cylindrical objects held in said reservoir, said chute being forward of the reservoir and rearward of the display position and defined by sidewalls, a front wall and a back wall, said front wall including rearwardly projecting ribs having beveled edges to guide the forward portion of a descending cylindrical object toward the center of said display position with low friction and said ribs being recessed to a plane forward of the reservoir to permit forward movement of a cylindrical object in moving to said ribs and being slanted forwardly to permit forward movement of a cylindrical object in moving from said ribs, said back wall being configured as a ramp formed of lateral shoulders with a central recess and including a forwardly extending curve having ripples in it positioned to include a first steeper ramp portion below a rear end of a cylindrical article at rest next above the cylindrical article in said display position and a second steeper ramp portion upstream of a rear end of a cylindrical article in said display position and downstream of a rear end of a cylindrical article at rest next above the cylindrical article in said display position, whereby upon loading a plurality of cylindrical objects into said reservoir, the chute and display position are filled with cylindrical objects and upon removal of a cylindrical object from said display position, cylindrical objects descend under the influence of gravity from said reservoir to said chute a vertical distance approximating the diameter of the cylindrical objects and a forward distance at least one half the length of the cylindrical objects and from said chute to said display position.

20. A method of displaying and dispensing cylindrical objects having a diameter and a length along an axis comprising providing a reservoir communicating with a downwardly and forwardly extending chute terminating in a forward display position axially distended from the reservior.

loading a plurality of cylindrical objects into the reservoir, and thereby filling the chute and display position with cylindrical objects, holding the plurality of cylindrical objects in the reservoir with a cylindrical object in the display position available for removal by hand, removing a cylindrical object from the display position, and thereby inducing cylindrical objects to descend under the influence of gravity from the reservoir forwardly through the chute to the display position and guiding such cylindrical objects as they move through the chute with rearwardly projecting ribs on a front portion of the chute.

21. A method as claimed in claim 20 wherein said holding step includes holding a cylindrical object next in line to descend to said display position forward of the reservoir and rearward of the display position.

22. A method as claimed in claim 20 wherein in the move induced by the removing step the cylindrical objects move a vertical distance approximating the diameter of the cylindrical objects and a forward distance at least one half the length of the cylindrical objects.

23. A method as claimed in claim 20 wherein in the move induced by the removing step, a cylindrical object moves toward the center of the display position with low friction.

24. A method as claimed in claim 23 wherein in the move induced by the removing step, a cylindrical object moves from the reservoir to the chute.

25. A method as claimed in claim 24 wherein in the move induced by the removing step, a cylindrical object moves from the chute to the display position.

26. A method as claimed in claim 20 wherein said loading step includes causing cylindrical articles being loaded to collide with baffles in the reservoir to prevent continuous movement of cylindrical articles.

27. A method as claimed in claim 20 wherein said loading step includes storing a plurality of cylindrical objects in a curved queue.

28. A method as claimed in claim 20 comprising loading a multiplicity of reservoirs and associated chutes and display positions on a common base.

29. A method as claimed in claim 20 for a reservoir including a back wall having apertures therein further comprising visually inspecting cylindrical articles in the reservoir through an aperture.

30. A method as claimed in claim 20 for a reservoir including a back wall having apertures therein further comprising inserting a tool to dislodge jammed ones of the cylindrical articles through an aperture.

* * * * *